US005425583A

United States Patent [19]

Wild

[11] Patent Number: 5,425,583

[45] Date of Patent: Jun. 20, 1995

[54] STANDUP BAG WITH AN IMPROVED PIERCING OPENING

[75] Inventor: Rainer Wild, Eppelheim/Heidelberg, Germany

[73] Assignee: Deutsche SiSi-Werke GmbH & Co., Betriebs KG, Heidelberg, Germany

[21] Appl. No.: 158,999

[22] Filed: Nov. 30, 1993

[30] Foreign Application Priority Data

Dec. 2, 1992 [DE] Germany ..... 42 40 540.8

[51] Int. Cl.[6] ..... B65D 33/36

[52] U.S. Cl. ..... 383/202

[58] Field of Search ..... 383/202; 229/204, 103.1

[56] References Cited

U.S. PATENT DOCUMENTS

| | | | |
|---|---|---|---|
| 3,596,829 | 8/1971 | Gardner | 229/103.1 |
| 4,072,233 | 2/1978 | Kramer et al. | 383/202 |
| 4,553,693 | 11/1985 | Terajima | 229/103.1 |
| 4,762,514 | 8/1988 | Yoshida | 229/103.1 |
| 4,858,766 | 8/1989 | Tsai | 229/204 |
| 5,201,460 | 4/1993 | Caines | 229/103.1 |

FOREIGN PATENT DOCUMENTS

| | | |
|---|---|---|
| 7518956 | 11/1975 | Germany . |
| 2829073 | 11/1979 | Germany . |
| 365997 | 2/1982 | Germany . |
| 3422679 | 8/1985 | Germany . |
| 3808303 | 9/1989 | Germany . |

*Primary Examiner*—Stephen P. Garbe

*Attorney, Agent, or Firm*—Tilton, Fallon, Lungmus & Chestnut

[57] ABSTRACT

The invention relates to a beverage container, in particular a beverage bag, made of a monomaterial or a multilayer compound material, which is provided with a piercing opening for inserting a straw.

In order to make a beverage container available which makes an easy insertion of a straw possible and, at the same time, is justifiable under the viewpoints of environmental protection, the piercing opening is punched through all layers of the mono- or compound material and a sealing foil is affixed to the inner side of the mono- or compound material around the piercing opening, which is outwardly exposed by the piercing opening.

16 Claims, 2 Drawing Sheets

STANDUP BAG WITH AN IMPROVED PIERCING OPENING

The invention relates to a beverage container, in particular a beverage bag made of a monomaterial or a multi-layer compound material, which is provided with a piercing opening for inserting a straw.

One of the most important problems consists in beverage containers of the type mentioned at the beginning in the easy opening of these bags, i.e. in providing an improved piercing possibility for the straw. There are in particular problems in the case of containers filled in hot sterile status during the insertion of the straw since there is steam in the head space of the container during filling, which condenses during cooling so that there is hardly any air in the head space. The result of this is that the piercing hole is now below the liquid level, due to which an uncontrolled liquid discharge may occur during careless opening. Moreover, the resilient and flexible bag becomes relatively flat due to the exerted piercing force, i.e. front and rear side are close together so that there is the risk during careless piercing that the rear side of the beverage container is also pierced. The problem of "piercing right through" is also attributable to the materials and material thicknesses used so far.

A solution of this problem is known from the patent specification AT 36 59 97, a preperforation extending up to the inner layer being provided in a beverage container made of multi-layer compound material, and the preperforation being covered by a multi-layer sealing strip, which is sealed to the exposed inner layer of the container wall in the area of the preperforation. When the sealing strip is torn off, the inner layer is torn, and a simple insertion of the drinking straw is thus made possible. However, the aforementioned solution entails considerable difficulties under the viewpoints of environmental protection, since the tear tab is not duly disposed of by the consumers, but is simply thrown away.

Proceeding from this, the present invention is based on the object of providing a beverage container which makes an easy insertion of a straw possible, and, at the same time, is also justifiable under the viewpoints of environmental protection.

According to the invention, this object is attained by punching the piercing opening through all layers of the mono- or compound material, and a sealing foil is affixed around the piercing opening, which is outwardly exposed by the piercing opening.

This solution makes a simple insertion of the straw possible without an additional tear tab to be affixed to the outer side, the piercing opening being exclusively sealed by a sealing foil affixed to the inner side of the mono- or compound material around the piercing opening.

The piercing opening can either be punched into the mono- or compound material as a piercing hole or in cross recessed fashion. A cross recessed piercing opening has the advantage that the material of the container wall is mostly still available as an oxygen barrier. Due to the selection of a suited sealing temperature, the triangular fields formed by the punching are easily sealed with the subjacent sealing foil so that they cannot bend outwardly. The triangular fields are then pressed inwards during insertion of the straw.

Polyethylene, polypropylene and copolymers are earmarked as materials for the sealing foil. The material with a thickness from 20 to 60 μm permits a simple insertion of the straw, whereby a piercing of the rear side of the bag and an uncontrolled discharge of the liquid from the piercing hole is avoided. The use of a compound foil as a sealing foil proves to be especially advantageous, whose structure can be as follows: sealing material, adhesive agent, barrier layer, adhesive agent, sealing material, polyethylene, polypropylene and copolymers coming into question as the sealing material, and materials such as EVOH, polyamides or polyvinyl alcohol being usable as the barrier layer. The sealing foil cannot only be produced as a coextrusion foil, but the individual foil layers can also be bonded by means of a coating adhesive. It is an advantage of such compound foils that the barrier layers are hardly oxygen-permeable and that thus an ideal protection of the filled substance is given.

The sealing foil can either be sealed around the piercing opening at the inner side of the mono- or compound material in annular, square, rectangular, grid-like or in concentric circles as "patches" in a material-saving fashion or they may be welded around the piercing opening as sealing foil strips and fixed to the side seams of the beverage bag by means of additional sealing points so that the sealing point at the piercing opening remains unstressed. It is decisive that a tight seal is formed around the piercing opening. The sealing foil can also be sealed all over around the piercing opening If the sealing foil strip is so wide that it projects into the area of the head sealing seam, there is sufficient sealable material in this critical area so that the head sealing seam can at any rate be safely sealed, also in view of any occurring foam formation and juice splashes. Due to the sealing material which is now additionally present at this point, the sealing layer of the front or rear side of the bag may be thinner, which leads to a most cost-efficient protection of the beverage bags. Sealing foil strips with a thickness of more than 60 μm can also be used in this connection.

A further advantage results in the production of the compound material which can e.g. be built up as follows from the outside to the inside:

Polyester foil/printing ink/coating adhesive/aluminum foil/coating adhesive/polyethylene foil. The coating adhesive applied between aluminum foil and polyester foil is exposed in conventional manufacturing processes due to the punching. Consequently, the adhesive must dry quickly so that the foil webs on the roll do not stick together. At present, this problem can only be solved by solvent-containing adhesives. However, if the hole in the polyester foil is renounced, since the piercing hole is only punched later in the course of bag manufacturing, there is the possibility of the use of a solventless adhesive, which, in turn, is positive under environmental viewpoints.

Examples of embodiment of the invention are explained in greater detail in the following by means of drawings.

Figure 1:
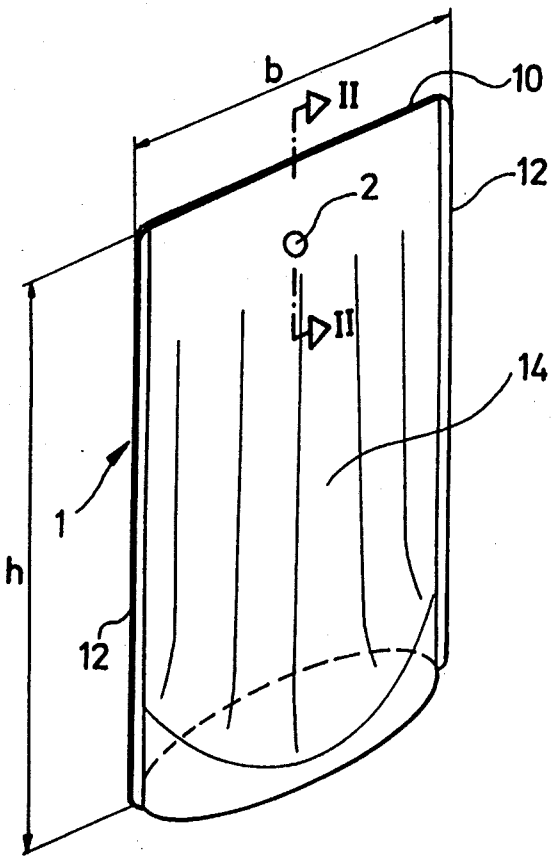
FIG. 1 shows a perspective view of a beverage bag.

FIG. 1 shows a perspective view of a beverage bag 1 made of a multi-layer compound material 3 with a piercing hole 2 for inserting a straw, with a height h and a width b.

Figure 2:
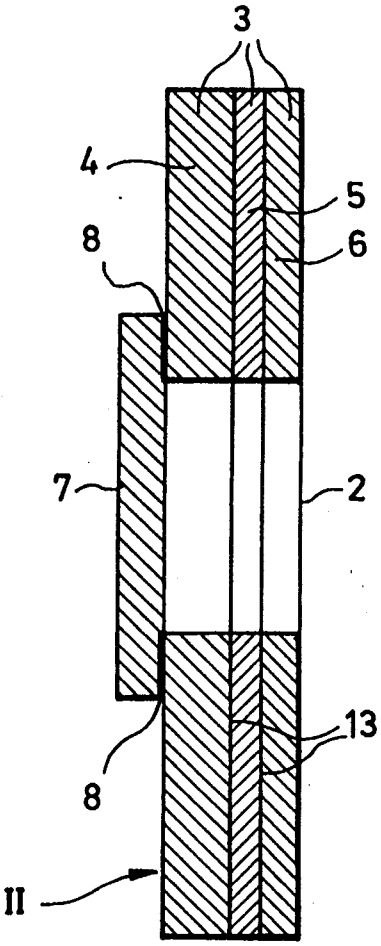
FIG. 2 shows a longitudinal section through the front bag wall of a beverage bag.

FIG. 2 shows a longitudinal section through the front bag wall 14 of the beverage bag 1, which consists of a triple compound material 3, which is built up as follows from the outside to the inside: polyester foil 6 (12 μm)/printing ink/coating adhesive 13/aluminum foil 5 (12 μm)/coating adhesive 13/polyethylene foil 4 (100 μm). Through all layers 4, 5, 6 a piercing hole 2 for inserting a straw is punched.

A sealing foil 7 is sealed around the piercing hole 2 at the sealing points 8 to the inner side of the multi-layer compound material. The beverage container is thus sealed by the sealing foil 17, which can easily be pierced with a straw.

Figure 3:
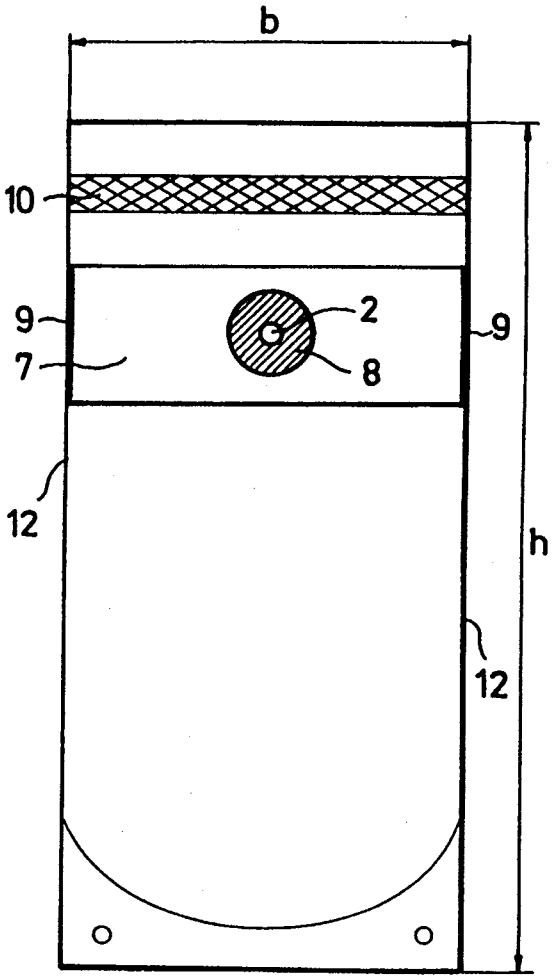
FIG. 3 shows schematically the sealing foil around the piercing hole at the inner side of the compound material according to a first example of embodiment.

FIG. 3 shows an example of embodiment of the invention, in which the sealing foil strip 7 is sealed to the sealing points 8 at the inner side of the compound material 3 and is additionally affixed to the side seams 12 of the beverage bag by means of sealing points 9. The sealing foil strip does not project into the head sealing seam 10 in this example of embodiment.

Figure 4:
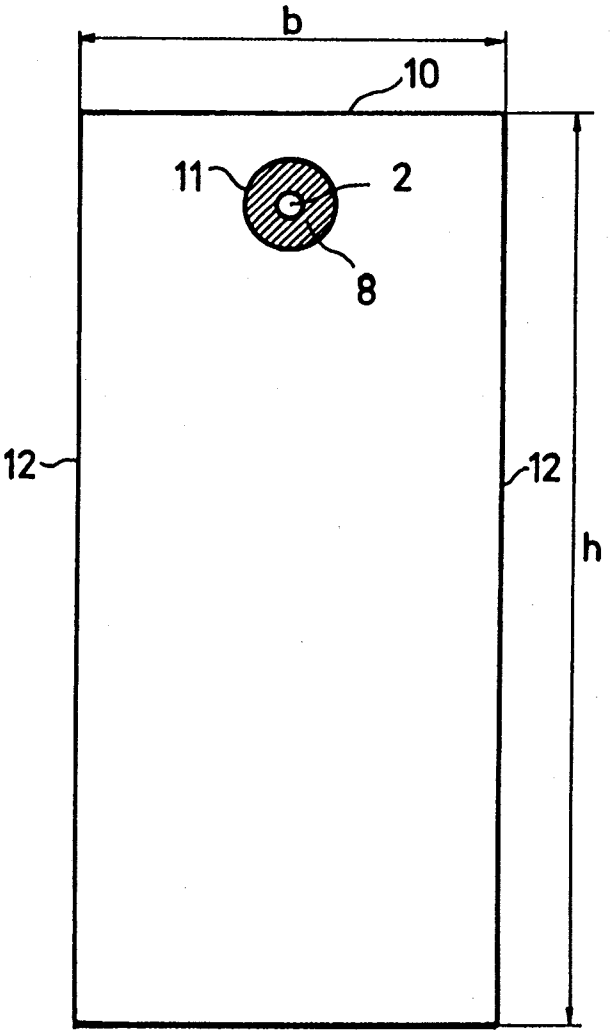
FIG. 4 shows schematically the sealing foil around the piercing hole at the inner side of the compound material according to a second example of embodiment.

FIG. 4 shows a further example of embodiment, the sealing foil 11 being sealed around the piercing hole 2 to the sealing points 8 at the inner side of the compound material 3 as "patches".

Figure 5:
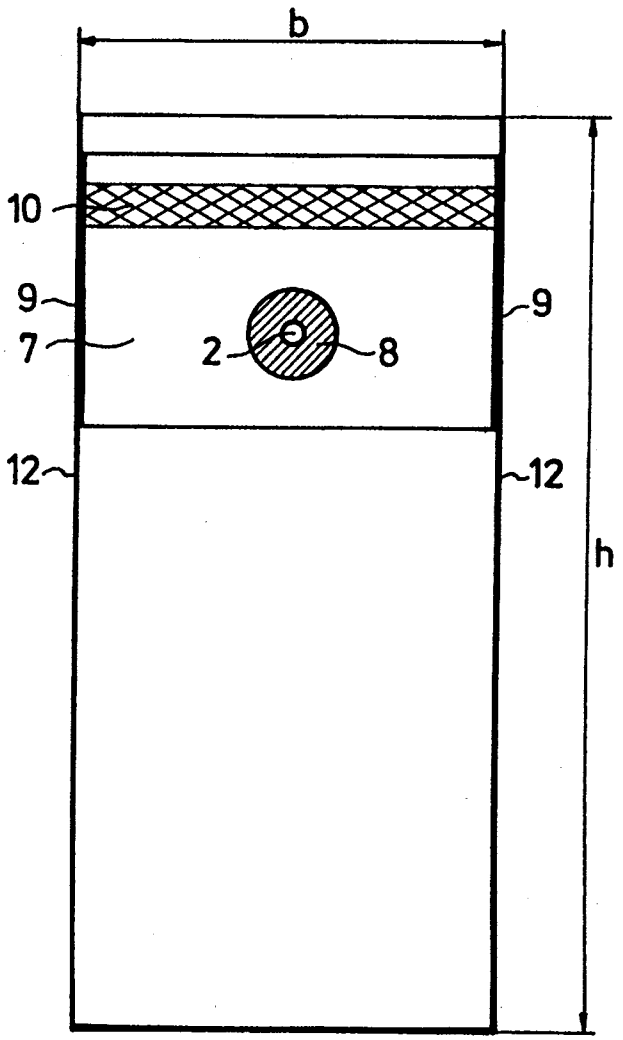
FIG. 5 shows schematically the sealing foil around the piercing hole at the inner side of the compound material according to a third example of embodiment.

FIG. 5 shows a third example of embodiment of the invention, the sealing foil strip 7 being affixed as in the example of embodiment represented in FIG. 3, but being so wide that it projects into the area of the head sealing seam 10 in order to be co-sealed to, whereby sufficient sealable material is present in order to safely seal the sealing seam 10 so that the inner polyethylene layer 4 can be reduced to a thickness of less than 90 to 100 μm.

The sealing of the sealing foil around the piercing hole 2 is of course not restricted to an annular shape as represented in the examples of embodiment. Either a monomaterial such as polyethylene or a compound foil can be used as sealing foil material, which can be built up as follows: polyethylene foil/adhesive agent-/EVOH/adhesive agent/polyethylene foil.

We claim:

1. A beverage container, in particular a beverage bag, including a sheet of material which forms a side wall of the container and included an outer surface, an inner surface, a first peripheral side edge, and a second, opposite, peripheral side edge, said sheet of material including a piercing opening, for inserting a straw therethrough, which is punched through said sheet of material from said outer surface to said inner surface, said container also including a sealing foil in the form of an elongated strip which is affixed to said inner surface and extends from said first peripheral side edge to said second peripheral side edge and covers said piercing opening, said sealing foil including a first sealing portion around said piercing opening and second and third sealing portions respectively at said first and second side edges, said sealing foil being outwardly exposed at a portion adjacent to said piercing opening, said sealing foil also being a compound foil composed of a plurality of layers.

2. A beverage container according to claim 1, wherein said sheet of material comprises a monomaterial.

3. A beverage container according to claim 1, wherein said sheet of material comprises a compound material.

4. A beverage container according to claim 2 or 3, wherein said piercing opening is punched in a cross-recess fashion in said sheet of material.

5. A beverage container according to claim 2 or 3, wherein said piercing opening is punched in the form of a piercing hole.

6. A beverage container according to claim 1, wherein said sealing foil is comprised of materials selected from the group consisting of polyethylene, polypropylene, and coploymers.

7. A beverage container according to claim 1, wherein said sealing foil is comprised of a first layer of sealing material adjacent to said inner surface, a second layer of an adhesive agent, a third layer of a barrier material, a fourth layer of an adhesive agent, and a fifth layer of a sealing material.

8. A beverage container according to claim 1, wherein said sealing foil includes a first layer of sealing material adjacent to said inner surface, a second layer of a coating adhesive, a third layer of a barrier material, a fourth layer of a coating adhesive, and a fifth layer of a sealing material.

9. A beverage container according to claim 7 or 8, wherein said barrier material consists of a material selected from the group consisting of EVOH, polyamides, and polyvinyl alcohol.

10. A beverage container according to claim 7 or 8, wherein said sealing material consists of a material selected from the group consisting of polyethylene, polypropylene, and coploymers.

11. A beverage container according to claims 1, 2, 3, 26, 27, or 28, wherein said sealing foil has a thickness of from about 20 to 120 μm.

12. A beverage container according to claim 1, 2, 3, 6, 27, or 28, wherein said sealing foil has a thickness of more than 60 μm.

13. A beverage container according to claim 1, wherein said sheet of material includes a head sealing seam and said sealing foil has a sufficient width such that said sealing foil projects into said head sealing seam.

14. A beverage container according to claim 1, wherein said sheet of material is composed of a three-layer compound foil including a first layer of polyester foil, a second layer of aluminum foil, and a third layer of a polyethylene foil, said polyester foil having a thickness of 9 to 15 μm, said aluminum foil having a thickness of 6 to 12 μm. and said polyethylene foil having a thickness of 80 to 100 μm.

15. A beverage container according to claim 14, wherein said polyethylene foil of said three-layered compound foil is thinner than 80 μm.

16. A beverage container according to claim 14, wherein said polyester foil and said aluminum foil are pasted together with solventless adhesive.

* * * * *